United States Patent [19]

McGlothlin et al.

[11] 4,422,928

[45] Dec. 27, 1983

[54] SILICA FLOTATION COLLECTORS DERIVED FROM ISONONYL ALCOHOL

[75] Inventors: Quentin T. McGlothlin, Spring; Barry M. O'Brien, Houston, both of Tex.

[73] Assignee: Exxon Research & Engineering Co., Florham Park, N.J.

[21] Appl. No.: 419,308

[22] Filed: Sep. 17, 1982

Related U.S. Application Data

[63] Continuation of Ser. No. 141,707, Mar. 9, 1981, abandoned.

[51] Int. Cl.[3] ..... B03D 1/14

[52] U.S. Cl. ..... 209/166; 252/61

[58] Field of Search ..... 252/61; 209/166, 167; 564/505, 508, 474, 475, 426, 504

[56] References Cited

U.S. PATENT DOCUMENTS

| | | | |
|---|---|---|---|
| 2,372,624 | 3/1945 | Carpenter | 209/165 |
| 3,076,819 | 2/1963 | Heise | 209/166 |
| 3,363,758 | 1/1968 | Cronberg | 209/166 |
| 3,404,165 | 10/1968 | Badde | 564/508 |
| 3,440,029 | 4/1969 | Little | 564/505 |
| 3,960,715 | 6/1976 | Dicks | 209/166 |
| 4,168,227 | 9/1979 | Polgaire et al. | 209/166 |
| 4,319,987 | 3/1982 | Shaw et al. | 209/166 |

FOREIGN PATENT DOCUMENTS

| | | | |
|---|---|---|---|
| 781510 | 3/1968 | Canada | 564/508 |

OTHER PUBLICATIONS

Villar & Dawe Mining Congress Journal Oct. 1975 vol. 61, No. 10, pp. 40–48.

Min Magazine Jan. 1977, pp. 25–31 Cationic Silica Flotation.

*Primary Examiner*—Bernard Nozick

*Attorney, Agent, or Firm*—Roland A. Dexter

[57] ABSTRACT

This invention relates to the use of a primary-branched aliphatic ether monoamine, 3-nonyloxypropylmonoamine, its ethoxylated or propoxylated derivatives and partial acid salts thereof, as a major or minor constituent in the formulation of superior silica flotation collectors. Such collectors are employed in the separation of silica from iron ore, phosphate, and other valuable ores.

7 Claims, No Drawings

SILICA FLOTATION COLLECTORS DERIVED FROM ISONONYL ALCOHOL

This is a continuation of application Ser. No. 141,707, filed Mar. 9, 1981 now abandoned.

The invention relates to the use of a primary branched aliphatic ether monoamine as silica flotation collectors in the concentration of minerals by the froth flotation process. More particularly, it relates to the use of 3-nonylpropyl-monoamine and partial acid salts as cationic flotation collectors in froth flotation of silica.

BACKGROUND OF THE INVENTION

Froth flotation is a common process applied to the art of separating or concentrating minerals from ore or the like. Briefly, the flotation process usually comprises grinding crushed ore, classifying the ground ore in water, treating the classified ore by flotation to concentrate one or more minerals while the remainder of the minerals of the ore remain behind in the water pulp, thickening and filtering the separated concentrate and thereafter treating the same for ultimate use of the separated minerals. In carrying out the flotation step, a chemical reagent, called the "collector" is added to the water-dispersed ore and air is introduced into the pulp to form a froth. This froth, containing those minerals that are wetted by the collector and consequently have an affinity for air bubbles, is then scooped away from the pulp.

A host of selective collecting agents have been developed that are used for forming water-repellent, air-avid surfaces on one mineral or a class of minerals. These collectors are anionic or cationic, and while many of them have been used satisfactorily, they often are limited by their solubility and handling characteristics, selectivity, effectiveness, stability, cost, etc.

In recent years, the enrichment of non-magnetic taconite iron ore deposits by a selective flocculation/desliming process, followed by froth flotation, has become an important commercial process. The application of this process to a large ore body located on the Marquette Range in Michigan (the Tilden Mine) is described in a paper:

Villar, J. W. and Dawe, G. A., "The Tilden Mine—a New Processing Technique for Iron Ore", Mining Congress Journal, October, 1975, Vol. 61, No. 10, pg. 40–48.

The process described in this paper utilizes a cationic flotation system following the selective flocculation/desliming step. The purpose of the cationic flotation system is to remove silica from the deslimed ore to produce an iron ore concentrate of commercial grade.

The cationic flotation system employs an amine collector. The principal amine collector utilized in the Tilden process has been an ether amine of the following general structure:

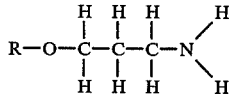

where R—O— is derived from a mixture of normal alcohols consisting predominantly of $C_8$ and $C_{10}$ carbon number alcohols. In use, the amine is typically partially neutralized (~30 percent) with acetic acid to improve water dispersability.

Other mono ether amines offered commercially for iron ore flotation are products where R—O— is derived from normal $C_{10}$ alcohols, methyl branched $C_{10}$ alcohols, normal $C_{12}$–$C_{14}$ alcohols, and normal $C_{16}$–$C_{18}$–$C_{22}$–$C_{26}$ alcohols. Other products which have been mentioned in the patent literature include products derived from normal $C_6$, $C_7$, $C_8$, $C_9$, $C_{10}$, $C_{11}$, $C_{12}$, $C_{13}$, $C_{14}$, $C_{15}$, etc. alcohols and various iso $C_8$ alcohols (see U.S. Pat. No. 3,363,758 for other starting alcohols).

Other products known for cationic flotation of iron ores include fatty amines, fatty beta-amines, various ether diamines (see U.S. Pat. Nos. 3,363,758 and 3,404,165) and, more recently, blends of alkyl amines/mono ether amines and alkyl amines/amino ethers (see U.S. Pat. No. 4,168,227).

The collector used in a cationic flotation process for iron ore is desired to achieve many, sometimes conflicting objectives. These requirements are outlined as follows:

1. Produce an Iron Ore Concentrate of Acceptable Quality

The final product must contain a sufficiently high iron content (generally 60+ weight percent Fe) and not exceed a given silica content to meet commercial standards. It is desirable that silica contents not exceed 5–6 weight percent $SiO_2$. In some cases, high purity (2–3 weight percent $SiO_2$) iron concentrates are required.

2. Recover the Maximum Quantity of Iron Consistent with Acceptable Quality

Iron recovery is of major economic importance to the plant operation. For example, improving iron recovery by 1 weight percent from a crude ore assying 35% Fe increases the return per ton by about 25 cents.

3. Achieve Acceptable Results with a Variety of Iron Ore Types

Variations occur in the specific type of iron ore encountered in day-to-day mining operations. A given deposit of ore may vary significantly in the amount of desired contained iron ore minerals (e.g., martite, hematite, magnetite, geothite, etc.) and in undesired gangue (quartz, clays, etc.). Commercial iron ore technology does not permit controlling the precise composition of the crude ore being fed to the concentrator (although attempts are made to minimize gross changes through control of mining and ore blending operations). Thus, a successful collector must give acceptable results with the normal commercial variations in ore types fed to the concentrator.

4. Be Sufficiently "Persistent" to Yield Acceptable Results Through Several Stages of Froth Flotation Sharp separations between the undesired silica mineral particles and the desired iron-containing mineral particles are not obtained in a single stage of froth flotation. Thus, in commercial practice, to remove enough silica in the Rougher Flotation cells to achieve commercial purity iron ore concentrate in the underflow, considerable amounts of iron ore are also removed in the froth. Loss of this iron would make the process uneconomic. Thus, the froth product from the Rougher Flotation cells is subjected to several subsequent cleaner froth flotation stages to further separate the desired iron ore from the undesired silica.

In theory, collector could be added at each stage of Rougher and Cleaner froth flotation. However, in commercial practice, collector is often added only to the Rougher cells. Even if additional collector is added at some stage of the cleaning process, this causes complications in process control.

As a practical consequence, a commercial collector must "persist" (i.e., continue to cause the silica mineral particles to float) through several stages of cleaner flotation.

It should be noted that this requirement for a successful collector has heretofore not been recognized in iron ore flotation as a specific property of a collector which should be determined.

5. Require Minimum Quantities of Collector to Achieve Acceptable Operations

While costs of collector are relatively small versus, for example, the value of improved iron recovery and/or the cost of unsatisfactory operations, these collector costs are still an important operating cost. It is general commercial practice to minimize the amount of collector used. Thus, collectors which achieve satisfactory operations at minimum treating rates are desired. Stated another way, a collector which gives a relatively-*flat* dose-response curve is preferred. Specifically, when the collector dosage (in lbs. collector per long ton of ore) is plotted against % Fe recovery (the response) at a given grade or quality of *iron concentrate,* the slope of the resulting curve should be as small as possible, optimally zero.

6. Continue to Achieve Equal or Improved Response at High Dosages

When plant operations become more difficult (for example, from changes in ore quality, lower water temperatures, and other factors), it is necessary to increase collector dosage to attempt to achieve target quality from the froth flotation operations. With some collectors, an increase of dosage resulted in a loss in selectivity between silica and iron ore, resulting in a drop in Fe recovery, i.e., the slope of the response—dosage curve referenced in (5) is negative at high dosages.

7. Continue to Achieve Good Performance Under Cold Weather Conditions

On the North American Continent, major iron ore deposits are located in Michigan, Minnesota, and Canada. It has been found that performance of the cationic flotation process becomes poorer when water temperatures drop, even though the specific mechanisms which cause this effect are not well understood. It is obviously desirable that a collector suffer the minimum drop in performance under cold water flotation.

It is also desirable, though less important, that a collector have good physical handling properties under cold weather conditions in its concentrated form. Obviously, lower viscosities and lower freezing points offer advantages in product unloading, pumping, and storage. Energy is saves through minimizing the need for heating the product.

It is an object of the invention to provide a cationic collector reagent which performs better than known collectors in meeting the foregoing requirements for the concentration of mineral ores, particularly for iron ores.

SUMMARY OF THE INVENTION

It has been discovered that an ether monoamine derived from isononyl alcohol provides an improved cationic collector reagent for the flotation concentration of finely ground and deslimed iron ore concentrates. In actual practice, and to facilitate water dispersability, said isononyl ether monoamine is often partially neutralized, i.e. up to 80% with an acid, preferably acetic acid, forming a partial acid, preferably acetate, salt.

The preferred concept of this invention can be represented by the general formulae:

$$R—O—CH_2—CH_2—CH_2—NH_2$$

or $$(R—O—CH_2—CH_2—CH_2—NH_3)^+(X)^-$$

wherein R represents any or all of the isomers of the isononyl radicals and X represents an anion such as acetate.

It has been also found that commercially available isononyl alcohol can be used. Commercially produced isononyl alcohol consists predominately of isomeric dimethyl heptanols and trimethyl hexanols, together with other isononyl alcohol isomers and also contains some lower boiling (isooctyl and isoheptyl alcohols) and higher boiling (isodecyl alcohol) components.

It is therefore within the broad concept of this invention to claim the usefulness of the isononyl derivative containing as little as 30% of the isononyl derivative together with as much as 70% of isooctyl and/or isodecyl derivatives. Further, it is within the preferred concept of this invention to claim the superior effectiveness of the isononyl derivative wherein at least 70% of the alcohol building block is isononyl alcohols, the remaining 30% or less being comprised of isooctyl or isodecyl alcohols.

DETAILED DESCRIPTION OF THE INVENTION

According to an article appearing in *Mining Magazine* January 1977, pages 25–31, entitled "Cationic Silica Flotation", mineral separation by froth flotation requires the use of chemical additives which can be categorized by function into three general types. They are: (1) the collector or flotation reagent which imparts the hydrophobicity to one mineral species, (2) the frother which lowers the aqueous surface tension to produce a semistable foam at the air-water interface, and (3) the modifiers or auxiliary reagents which are used to enhance the selective adsorption of the collector to a specific mineral surface and include, in the case of cationic silica flotation, depressants, dispersants, and pH regulators.

The ether monoamine collectors of the invention are by nature cationic surfactants. The amino groups ($—NH_2$) attach to silica and silica materials, providing the required selectivity for flotation, while the ether linkages (R—O—C) give these materials relatively low melting points and good dispersibility. Although useful in free amine form, the collectors of the invention may be partially to fully neutralized for direct dispersion in water.

The primary methyl-branched ether amines and partially to fully neutralized salts thereof preferably employed to obtain mixtures useful in the practice of this invention can be represented by the general formulae:

(a) $R—O—CH_2—CH_2—CH_2—NH_2$ AMINE where R— is a methyl-branched aliphatic radical having 9 carbon atoms. The number of methyl radicals in said branched aliphatic radical may be from 1 to 5, preferably 2 or 3; or (b)
$(R—O—CH_2—CH_2—CH_2—NH_3)^+(X)^-$
PARTIALLY-NEUTRALIZED SALT OF AMINE where R— is as described in formula (a) and X is a water solubilizing mono or polyvalent anion such as fluoride, chloride, iodide, bromide, acetate or other organic anion such as oxalate, sulfonate, salicylate and the like, phosphate, borate, nitrate, perchlorate, sulfate, etc.; the preferred anion being acetate.

The degree to which the aliphatic ether amine may be neutralized is such that water dispersibility is sufficient to provide adequate dispersion in the flotation mixtures while remaining liquid . . . said degree of neutralization being from 0 to 80 mole percent, perferably in the 10 to 50 percent range.

The methyl-branched nonyl ether amine acetates which may be used in this invention may be prepared from the corresponding methyl-branched, preferably oxo, nonyl alcohols by the well-known cyanoethylation reaction, subsequent catalytic reduction, and neutralization with the conjugate acid of the desired anion.

The "oxo" process is well known for the production of alcohols by passage of olefin hydrocarbon vapors over cobalt catalysts in the presence of carbon monoxide and hydrogen.

The thus prepared methyl-branched nonyl ether amine acetates are liquids which may have low pour points, said low pour point being a desirable property because this eliminates the need for heating storage tanks during cold weather.

The amount of ether monoamine collector blend use in the froth flotation process will vary and be dependent upon such factors as the type of ore being treated, the amount of mineral to be collected, the degree of subdivision of such minerals, the degree of separation desired, and the degree of neutralization. Functionally expressed, the amount of ether amine acid salt reagent used in such froth flotation process will be that sufficient to achieve a desirable separation. Generally, the amount of ether amine acid salt used will be 0.05 to 2 pounds, preferably 0.1 to 0.3 pound, per ton of ore.

The ether amine acid salt reagent can be employed as a solution or dispersion in water or other solvent and introduced into the ore pulp as such without prior conditioning or can be conditioned with the ore pulp prior to the actual concentration operation. In addition, the reagents of this invention can be used in conjunction with other conventional treating agents such as activators, frothing agents, depressing agent, dispersing agents, etc.

In carrying out the practice of this invention, the general well known technique of the froth flotation process is used. Briefly, the ore, or a concentrate of the ore, is ground and mixed with water to form a pulp. The pulp is placed in a suitable flotation cell or vessel provided with an agitator. Air is introduced into the pulp by means of a sparger and passes through the pulp. The froth that is formed is skimmed off or allowed to overflow. The silica floats away with the froth, leaving the mineral concentrate behind. In this manner, the silica or siliceous material is separated from the desired mineral. Although this invention is particularly applicable in removing silica from iron ore, such as magnetite, it can be used in concentrating any silica-containing minerals or ores, such as hematite, goethite, phosphate rock, etc.

The following examples further illustrate the advantages and objects of this invention, but the various reagents, conditions of treatment, and other details recited in these examples should not be construed to unduly limit this invention.

EXAMPLE 1

Illustrative of the preparation of the nonyl ether monoamines and their respective partially neutralized salts, utilized in the collector evaluations hereafter reported, is the following:

A quantity of isononyl alcohol or mixtures of isononyl along with isooctyl and/or isodecyl alcohols such as commercially available oxo nonyl alcohol appropriate for testing were in each instance reacted with a slight molar excess of acrylonitrile in the presence of sodium methylate over a four hour period at a temperature ranging from 25° C. to 40° C.

The sodium methylate in the reaction mixture was neutralized with acetic acid, followed by filtration of the mixture through filter paper while under reduced pressure.

Hydrogenation was carried out under pressure with a mixture of ammonia and hydrogen in the presence of Raney nickel at from 300 to 600 psig at 140° C. for from 4 to 5 hours. The amine was purified by filtration after which 0.3 mole of acetic acid for each mole of ether amine was added with stirring while keeping the temperature below 43° C.

Aside from commercially available ether monoamines (clearly referenced hereafter) the various amines reported herein were similarly produced.

Evaluation Criteria for the Invention

It has been found that variations occur in the specific type of iron ore encountered in day-to-day commercial mining operations within a given ore body. Ore bodies exhibiting this property are said to have "subtype ores".

These variations can affect the performance of the silica collector used in separation of the silica from the iron concentrate. In fact, it is not uncommon for one specific flotation collector to work best for one ore subtype, while another specific collector is best for another ore subtype. Therefore, the various ore subtypes must be investigated individually in order that the *best single* flotation collector can be selected. Obviously, this decision is very often a compromise.

Two different subtypes of Martite Ore from a single commercial iron ore mining site have been isolated and characterized as seen below in Table I.

TABLE I

CHARACTERIZATION OF TWO SUBTYPES OF MARTITE ORE WITHIN THE SAME GENERAL ORE BODY

| | Ore "A" | Ore "B" |
|---|---|---|
| General Constituents | Martite and Quartz | Martite, Quartz and Goethite |
| % Fe | 35.9 | 33.6 |
| % $SiO_2$ | 46.3 | 47.5 |
| % Loss on ignition | 0.61 | 2.33 |
| % Goethite in ore (based on LOI data) | 6.0 | 20.0 |
| Goethite as a % of total contained Fe | 10.0 | 38.0 |

For the purposes, then, of illustrating the novelty and unexpected superiority of this invention, a series of commercially-available (as well as some experimental) silica flotation collectors will be evaluated as to iron recovery when used in treating both Ore Subtype "A" and Ore Subtype "B".

EXAMPLE 2

Performance Evaluation of the Most-Common Commercially-Available Silica Flotation Reagents . . . the Linear Alcohol Derivatives The following alcohols are the most-common and/or commercially-available linear alcohols applicable as "building blocks" for cationic silica flotation collectors:

Linear (normal) octyl alcohol (Conoco Alfol 8)
Linear $C_9$-$C_{11}$ alcohol (Shell Neodol)
Linear (normal) decyl alcohol (Conoco Alfol 10).
Linear $C_8/C_{10}$ (48%/52%) alcohol (Conoco Alfol 810).

Converting each of these alcohols into ether monoamines, neutralizing them to the 30% acetate salt, and testing each as flotation collector for Ore Subtype "A", the following results are obtained.

TABLE II

ORE SUBTYPE "A": % Fe RECOVERY AT 65% Fe GRADE

| Reagent | Reagent Dosage, Lbs/Long Ton of Ore | | | | |
|---|---|---|---|---|---|
| | 0.20 | 0.25 | 0.30 | 0.35 | 0.40 |
| Linear $C_8$ derivative | 45.5 | 73.2 | 76.6 | 79.0 | 79.2 |
| Commercially available linear $C_8/C_{10}$ derivative | | 59.6 | 78.5 | 80.7 | 80.6 |
| Linear $C_{10}$ derivative | | 56.2 | 74.0 | 77.4 | 79.9 |
| Linear $C_9/C_{11}$ derivative | | 57.6 | 71.1 | 75.0 | N/A |

From the above data, it is apparent that for Ore Subtype "A", among the linear derivatives, the linear $C_8$ derivative is *best,* yielding relatively-high recovery values at dosage levels as low as 0.25 lbs/ton. However, the commercially-available $C_8/C_{10}$ derivative is a close second, yielding very high recovery values at the higher (0.30 to 0.40 lb/T dosages). Both reagents will be considered for further comparison with the isononyl derivatives. Utilizing the aforementioned partially-neutralized linear reagents as flotation collectors for Ore Subtype "B", the following results set forth in Table III were obtained.

TABLE III

ORE SUBTYPE "B": % Fe RECOVERY AT 63% Fe GRADE

| Reagent | Reagent Dosage, Lbs/Long Ton of Ore | | | | |
|---|---|---|---|---|---|
| | 0.20 | 0.25 | 0.30 | 0.35 | 0.40 |
| Linear $C_8$ derivative | | 68.1 | 77.1 | 79.2 | 80.1 |
| Commercially available linear $C_8/C_{10}$ derivative | | 54.1 | 72.5 | 73.1 | 74.8 |
| Linear $C_{10}$ derivative | | * | * | 59.6 | 59.3 |
| Linear $C_9/C_{11}$ derivative | | ** | ** | ** | ** |

*Denotes failure - inability to make 63% Grade
**Not tested

From table III, it is apparent that the linear $C_8$ derivative is clearly superior to the other linear reagents tested including the commercially-available $C_8/C_{10}$ derivative. However, because of its acceptable performance upon Ore Subtype "A", the linear $C_8/C_{10}$ derivative, as well as the linear $C_8$ derivative, will be considered for further comparison with the isononyl derivatives.

EXAMPLE 3

Performance Evaluation of Derivatives of the Most-Common Commercially-Available Branched Chain Alcohol Building Blocks The following alcohols are the most common and/or commercially-available *branched-chain* alcohols applicable as building blocks for cationic silica flotation collectors: 2-ethyl hexyl alcohol; isooctyl alcohol; $C_8/C_{10}$ (50%/50%) isooctyl/isodecyl alcohol; and, isodecyl alcohol.

Converting each of these branched-chain alcohols into ether monoamines, neutralizing them to the 30% acetate salt, and testing them as flotation aids for Ore Subtype "A", the following results shown in Table IV were obtained.

TABLE IV

ORE SUBTYPE "A": % Fe RECOVERY AT 65% Fe GRADE

| Reagent | Reagent Dosage Lbs/Long Ton of Ore | | | | |
|---|---|---|---|---|---|
| | 0.20 | 0.25 | 0.30 | 0.35 | 0.40 |
| Branched $C_8/C_{10}$ derivative | 70.7 | 76.0 | 80.5 | 82.7 | 84.2 |
| Branched $C_{10}$ (isodecyl) derivative | 58.8 | 77.7 | 82.4 | 83.1 | ** |
| Branched $C_8$ (isooctyl) derivative | 52.3 | 73.8 | 76.1 | 76.7 | ** |
| 2-ethyl Hexyl derivative | * | 55.6 | 67.9 | 73.8 | 75.8 |

*Denotes failure - inability to make 65% Grade
**Tests not conducted

From Table IV, it is obvious that for Ore Subtype "A", the branched $C_8/C_{10}$ (50%/50%) and the $C_{10}$ isodecyl derivatives are clearly superior to the others. Both will be considered for further comparison with the isononyl derivatives.

Utilizing the aforementioned partially-neutralized branched chain reagents as flotation collectors for Ore Subtype "B", the following results, shown in Table V, were obtained:

TABLE V

ORE SUBTYPE "B": % Fe RECOVERY AT 63% Fe GRADE

| Reagent | Reagent Dosage, Lbs/Long Ton of Ore | | | | |
|---|---|---|---|---|---|
| | 0.20 | 0.25 | 0.30 | 0.35 | 0.40 |
| Branched $C_8$ (isooctyl) derivative | | 71.3 | 70.6 | 76.4 | 80.5 |
| Branched $C_8/C_{10}$ derivative | | 65.0 | 70.7 | 75.7 | 73.8 |
| Branched $C_{10}$ derivative | | * | 67.8 | 68.4 | 71.2 |
| 2-ethyl Hexyl derivative | | ** | ** | ** | ** |

*Denotes failure - inability to make 63% Grade
**Tests not conducted

The results in Table V indicate that for Ore Subtype "B", the branched $C_8$ derivative is superior, with the 50%/50% $C_8/C_{10}$ branched $C_8/C_{10}$ derivative rating as an acceptable reagent for further comparison with the isononyl derivatives.

EXAMPLE 4

Performance Evaluation of Various Concentrations of the Claimed Invention The isononyl Alcohol Derivatives Commercially produced isononyl alcohol normally contains between 95 and 70% isononyl alcohols, with the remainder being comprised of isooctyl and/or isodecyl alcohols. Accordingly, for this study, the starting alcohol for the claimed invention, isononyl alcohol, has been evaluated at a series of commercial purity levels: 93%, 84%, 74%, and 50% isononyl alcohols. Converting each of these $C_9$ solutions into ether monoamines, neutralizing them to the 30% acetate salt, and testing them as flotation collectors for Ore Subtype "A", the following data, shown in Table VI, were obtained:

TABLE VI

ORE SUBTYPE "A": % Fe RECOVERY AT 65% Fe GRADE

| Reagent | Reagent Dosage, Lbs/Long Ton of Ore | | | | | |
|---|---|---|---|---|---|---|
| | 0.15 | 0.20 | 0.25 | 0.30 | 0.35 | 0.40 |
| 93% pure $C_9$ derivative | 70.2 | 79.5 | 82.9 | 83.6 | 85.9 | 87.6 |
| 84% pure $C_9$ derivative | 67.9 | 78.6 | 82.1 | 83.1 | 86.2 | 86.9 |
| 74% pure $C_9$ derivative | 56.2 | 79.8 | 80.7 | 82.1 | 84.0 | 84.9 |
| 50% pure $C_9$ derivative | * | 76.2 | 82.0 | 83.0 | 84.2 | 85.0 |

*Tests not conducted

From Table VI, it is obvious that all of the derivatives containing $C_9$ are *extremely* effective collectors for the Ore Subtype "A". Most significant is that this family of collectors appears to display an extremely flat response curve, viz., the reagents appear to be effective at a wide range of dosages. Finally, one notes that—in general—the higher the $C_9$ purity, the better the iron recovery.

Utilizing the aforementioned partially-neutralized $C_9$ derivatives as flotation collectors for Ore Subtype "B", the following results, shown in Table VII, were obtained:

TABLE VII

ORE SUBTYPE "B": % Fe RECOVERY AT 63% Fe GRADE

| Reagent | Reagent Dosage, Lbs/Long Ton of Ore | | | | |
|---|---|---|---|---|---|
| | 0.20 | 0.25 | 0.30 | 0.35 | 0.40 |
| 93% Pure $C_9$ derivative | N/A | 75.0 | 78.0 | 79.5 | 82.1 |
| 84% Pure $C_9$ derivative | 56.5 | 74.0 | 81.0 | 83.6 | 83.0 |
| 74% Pure $C_9$ derivative | 57.3 | 71.7 | 73.3 | 79.3 | 79.0 |
| 50% Pure $C_9$ derivative | * | * | * | * | * |

*Tests not conducted

Table VII indicates that the $C_9$ derivatives also appear to be excellent flotation collectors for Ore Subtype "B". As was the case for Ore Subtype "A", the $C_9$ derivatives apparently have a very flat response curse, especially for concentrations as 0.25 lbs/ton and above. It also appears that, in the case of Ore Subtype "B", the 84% purity material appears to be at least as good as, perhaps better than, the 93% purity $C_9$ derivative.

EXAMPLE 5

Performance of the Claimed Invention versus Performance of the Best Linear and Branched Chain Ether Amine Collectors Ore Subtype "A"

Recalling and reorganizing the best of the data shown in Tables II, IV and VI, one is able to determine the relative performance of various reagents upon Ore Subtype "A" as shown in Table VIII.

TABLE VIII

ORE SUBTYPE "A": % Fe RECOVERY AT 65% Fe GRADE

| Reagent | Reagent Dosage, Lbs/Long Ton or Ore | | | | |
|---|---|---|---|---|---|
| | 0.20 | 0.25 | 0.30 | 0.35 | 0.40 |
| Best Linear | | | | | |
| Linear $C_8$ derivative | 45.5 | 73.2 | 76.6 | 79.0 | 79.2 |
| Commercial Linear $C_8/C_{10}$ derivative | | 59.6 | 78.5 | 80.7 | 80.6 |
| Best Branched | | | | | |
| Branched $C_8/C_{10}$ derivative | 70.7 | 76.0 | 80.5 | 82.7 | 84.2 |
| Branched $C_{10}$ derivative | 58.8 | 77.7 | 82.4 | 83.1 | |
| Invention: Methyl Branched $C_9$ | | | | | |
| 93% pure $C_9$ derivative | 79.5 | 82.9 | 83.6 | 85.9 | 87.6 |
| 84% pure $C_9$ derivative | 78.6 | 82.1 | 83.1 | 86.2 | 86.9 |
| 74% pure $C_9$ derivative | 79.8 | 80.7 | 82.1 | 84.0 | 84.9 |
| 50% pure $C_9$ derivative | 76.2 | 82.0 | 83.0 | 84.2 | 85.0 |

The comparative data of Table VIII demonstrates the rather dramatic superiority of the methyl-branched $C_9$ derivatives—*at all concentrations down to* 50% by volume—to the *best* of the linear and branched alcohol derivatives evaluated. Not only do the $C_9$ derivatives yield higher recoveries at the mid and higher range dosages, but they also offer relatively good recoveries at the extremely low dosages of 0.20 and 0.15 lbs/ton. Further, the extremely flat response curve of the $C_9$ derivatives across the entire dosage range, is in marked contrast to the curves of the best linear or branched derivatives.

It is also interesting to recall (from Table II) the extremely poor performance of the *linear* $C_9/C_{11}$ derivative and to contrast this performance with that of the unique branched $C_9$ derivatives at concentrations as low as 50%.

Ore Subtype "B"

Recalling the best of the data shown in Tables III, V, and VII, one can produce the following Table IX relating the performance of various reagents upon Ore Subtype "B".

TABLE IX

ORE SUBTYPE "B": % Fe RECOVERY AT 63% Fe GRADE

| Reagent | Reagent Dosage, Lbs/Long Ton of Ore | | | |
|---|---|---|---|---|
| | 0.25 | 0.30 | 0.35 | 0.40 |
| Best Linear | | | | |
| Linear $C_8$ derivative | 68.1 | 77.1 | 79.2 | 80.1 |
| Commercial linear $C_8/C_{10}$ derivative | 54.1 | 72.5 | 73.1 | 74.8 |
| Best Branched | | | | |
| Branched $C_8$ derivative | 71.3 | 70.6 | 76.4 | 80.5 |
| Branched $C_8/C_{10}$ derivative | 65.0 | 70.7 | 75.7 | 73.8 |
| Invention: Methyl-branched $C_9$ derivative | | | | |
| 93% pure $C_9$ derivative | 75.0 | 78.0 | 79.5 | 82.1 |
| 84% pure $C_9$ derivative | 74.0 | 81.0 | 83.6 | 83.0 |
| 74% pure $C_9$ derivative | 71.7 | 73.3 | 79.3 | 79.0 |

As Table IX clearly demonstrates, the claimed invention (the methyl-branched $C_9$ derivatives) at each of the concentrations tested, were superior to the best linear and best branched reagents, when used in treating Ore Subtype "B".

While all tests indicate that Ore Subtype "B" is a "tougher" ore to treat than Subtype "A" (recovery values, even at a lower 63% grade, are slightly lower for each reagent), the methyl-branched $C_9$ derivatives continue to demonstrate: (a) the relatively-flat response curve property, and (b) the ability to treat well at low dosages.

In summary, the claimed invention, the methyl-branched $C_9$ derivative, is an extraordinarily (and surprisingly) effective flotation collector for each of the two major ore subtypes which characterize a large, commercial iron ore mining operation in the U.S. Great Lakes area.

EXAMPLE 6

Other Significant Properties of the Invention

While the matter of flotation performance (grade, recovery, and dosage relationship) are of prime importance in the evaluation of a flotation collector, there are also (as mentioned in the background section of this document) other criteria upon which collectors should be evaluated. Most important among these are persistency index, and low-temperature handling properties.

Table X is an appraisal of the methyl-branched $C_9$ derivative versus the linear and branched derivatives insofar as these criteria are concerned:

TABLE X

PROPERTIES OF CATIONIC COLLECTORS: CLAIMED INVENTION VS. TYPICAL OTHER REAGENTS

| Property | Invention: 74% Methyl-Br. $C_9$ Derivative | Linear $C_8$ Deriv. | Comm'l Linear $C_8/C_{10}$ Deriv. | Branched $C_8$ Deriv. | Branched $C_8/C_{10}$ Deriv. | Criteria for Acceptability |
|---|---|---|---|---|---|---|
| Persistence Index[1] | | | | | | |
| Ore "A" at 0.30 lbs/ton | 12.9 | 5.6 | 9.7 | 4.3 | 12.2 | (Must be greater than 6.5–7.0) |
| Ore "B" at 0.30 lbs/ | 14.6 | 15.2 | 12.8 | 6.6 | 13.3 | |
| Low Temperature Handling Properties,[2] of | liquid at −80° F. | 0° F. | 0° F. | liquid at −80° F. | liquid at −80° F. | Lower the Better |

As you will note from Table X, the claimed new invention meets each of the supplementary evaluation criteria for silica flotation collectors.

[1]Persistence Index is defined as the ratio of the weight of material floated in the #4 flotation cleaner stage to the weight of the material not floated with an indice of at least 6.5 to 7.0 necessary for a collector to adequately maintain flotation through a four-stage flotation process.

[2]As measured by ASTM D-97-66.

EXAMPLE 7

Full Scope of the Invention

Further research upon the properties of the methyl-branched isononyl ether amine derivatives have led the inventors into another promising series of compounds related to the structures previously disclosed in this document.

Specifically, it has been found that the addition of one or more moles of ethylene or propylene oxide to the methyl-branched isononyl alcohol yields promising flotation collectors when said ethoxylated or propoxylated alcohols are converted into ether amines and ether amine acetates via the process described in Example 1 of this memorandum. These new structures can be diagrammed chemically as follows:

Ethoxylated Structures

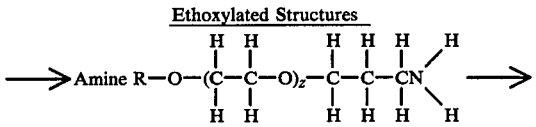

A.

-continued and

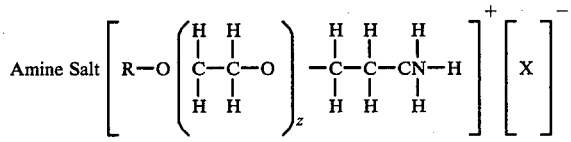

Propoxylated Structures

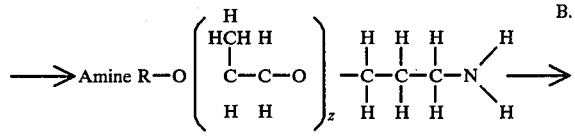

B.

and

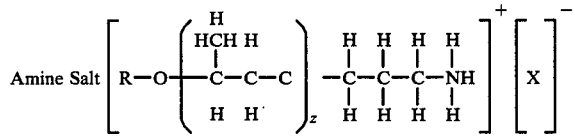

wherein R is a methyl-branched isononyl radical as early defined, X is an anion as earlier defined, and Z is an integer of from 1 from 10, preferably 2 to 5. As Table XI (below) indicates, when evaluated as flotation collectors upon the previously described Ore Subtype "A", the ethoxylated and propoxylated methyl-branched isononyl derivatives yield promising results . . . results quite *unlike* similar ethoxylated or propoxylated derivatives of methyl-branched isooctyl or isodecyl alcohols.

TABLE XI

RELATIVE Fe RECOVERIES OF ETHOXYLATED AND PROPOXYLATED ALCOHOL DERIVATIVES UPON ORE SUBTYPE "A" @ 65% GRADE

| | Reagent | Relative % Recovery vs. Standard |
|---|---|---|
| Methyl-branched isononyl series | 74% iso nonyl derivative | Base std. |
| | Ethoxylated (1 mole) 74% iso nonyl derivative | +1.5% recovery |
| | Propoxylated (1 mole) 74% iso nonyl derivative | (0.2%) recovery* |
| Methyl-branched isooctyl series | Branched chain $C_8$ derivative | Base std. |
| | Ethoxylated (1 mole) $C_8$ derivative | Failure** |
| | Propoxylated (1 mole) $C_8$ derivative | Failure** |
| Methyl-branched | Branched chain $C_{10}$ derivative | Base std. |
| | Ethoxylated (1 mole) $C_{10}$ | (1.5%) recovery |

TABLE XI-continued

RELATIVE Fe RECOVERIES OF ETHOXYLATED AND PROPOXYLATED ALCOHOL DERIVATIVES UPON ORE SUBTYPE "A" @ 65% GRADE

| | Reagent | Relative % Recovery vs. Standard |
|---|---|---|
| isodecyl series | derivative | |
| | Propoxylated (1 mole) $C_{10}$ derivative | Failure** |

*0.2% is essentially equivalent to base std. recovery.
**Failure is noted when reagent fails to elicit 65% Fe Grade.

As can be noted above, either one mole of ethylene oxide or one mole of propylene oxide is detrimental to the performance of the isooctyl and isodecyl alcohol derivatives. Surprisingly enough, however, the methyl-branched $C_9$ derivative appears to be *improved* by the addition of one mole of ethylene oxide, and essentially unaffected by the addition of one mole of propylene oxide.

Thus the ether monoamine of the invention is an isononyl ether propyl monoamine, derived from isononyl alcohol and has the general formulas $$RO—(R^1O)_z—C_3H_6—NH_2$$

or $$[RO—(R^1O)_z—C_3H_6—NH_3]^+[X]^-$$

wherein R is isononyl, $R^1$ is ethyl or propyl, z is an integer of from 0 to 10 and X represents an anion. In the earlier noted preferred concept of the invention, Z is zero.

The invention in its broader aspect is not limited to the specific details shown and described and departures may be made from such details without departing from the principles of the invention and without sacrificing its chief advantages.

What is claimed is:

1. A froth flotation process for separating silica from iron ore, which comprises frothing said ore in an aqueous medium in the presence of 0.1 to 2 pounds per ton of said ore of a water dispersible, liquid aliphatic ether amine having the general formula:

$$R—O—(R^1—O)_z—CH_2—CH_2—CH_2—NH_2$$

where R— is an aliphatic methyl branched radical having 9 carbon atoms, $R^1$ is ethyl or propyl and z is an integer of from 0 to 10.

2. The process according to claim 1 wherein said iron ore is hematite.

3. The process according to claim 1 wherein said iron ore is martite.

4. The process according to claim 1 wherein said iron ore is goethite.

5. The process according to claim 1 wherein z is 1 and $R^1$ is ethyl.

6. The process according to claim 1 wherein said ether amine is partially neutralized with a solubilizing anion.

7. The process according to claim 6 wherein said anion is acetate.

* * * * *